US011682378B2

(12) United States Patent
McLaughlin et al.

(10) Patent No.: US 11,682,378 B2
(45) Date of Patent: Jun. 20, 2023

(54) ACOUSTIC LENS FOR SAFETY BARRIERS

(71) Applicant: Signal Essence, LLC, Mountain View, CA (US)

(72) Inventors: Hugh Joseph McLaughlin, Mountain View, CA (US); Ryan Hugh McLaughlin, Mountain View, CA (US)

(73) Assignee: SIGNAL ESSENCE, LLC, Mountain View, CA (US)

( * ) Notice: Subject to any disclaimer, the term of this patent is extended or adjusted under 35 U.S.C. 154(b) by 313 days.

(21) Appl. No.: 17/201,952

(22) Filed: Mar. 15, 2021

(65) Prior Publication Data

US 2021/0225354 A1 Jul. 22, 2021

Related U.S. Application Data

(60) Provisional application No. 63/126,175, filed on Dec. 16, 2020.

(51) Int. Cl.

| | |
|---|---|
| ***G10K 11/30*** | (2006.01) |
| ***G10K 11/18*** | (2006.01) |
| ***E04B 1/99*** | (2006.01) |
| ***G10L 21/02*** | (2013.01) |

(52) U.S. Cl.

CPC ..... *G10K 11/18* (2013.01); *G10L 21/02* (2013.01)

(58) Field of Classification Search

CPC ..... G10K 11/18; G10K 11/20; G10K 11/30; G10K 11/26; G10K 11/28; G10L 21/02; E01F 8/00; E01F 8/0005; E01F 8/0094; E04B 1/99

See application file for complete search history.

(56) References Cited

U.S. PATENT DOCUMENTS

| | | | | | |
|---|---|---|---|---|---|
| 2,033,337 | A | * | 3/1936 | Harmer | G10K 11/28 181/177 |
| 2,819,771 | A | | 1/1958 | Kock | |
| 2,848,058 | A | * | 8/1958 | Hartsfield | H04R 1/345 181/176 |
| 3,957,134 | A | * | 5/1976 | Daniel | G10K 11/30 181/176 |
| 3,980,829 | A | * | 9/1976 | Beveridge | H04R 1/30 181/176 |
| 4,069,768 | A | * | 1/1978 | Matsumoto | G10K 11/175 104/124 |

(Continued)

FOREIGN PATENT DOCUMENTS

| | | | | | |
|---|---|---|---|---|---|
| GB | 2004170 | A | * | 3/1979 | G10K 11/30 |
| JP | 02013602 | A | * | 1/1990 | E01F 8/0094 |

(Continued)

OTHER PUBLICATIONS

International Search Report and Written Opinion, PCT Application No. PCT/US2021/063031, dated Feb. 14, 2022, 9 pages.

*Primary Examiner* — Edgardo San Martin
(74) *Attorney, Agent, or Firm* — Fountainhead Law Group P.C.

(57) ABSTRACT

An acoustic lens is presented that redirects high frequency voice sounds over a barrier to improve the intelligibility of speech when a protective barrier is used to isolate people from each other. The acoustic lens includes curved sheets to delay sound to create focal points on each side of a barrier, where the focal points are lower than the top of the barrier.

21 Claims, 18 Drawing Sheets

(56) References Cited

U.S. PATENT DOCUMENTS

| | | | | | |
|---|---|---|---|---|---|
| 4,156,476 | A * | 5/1979 | Matsumoto | G10K 11/175 | 181/292 |
| 4,158,401 | A * | 6/1979 | Matsumoto | E01B 2/003 | 181/292 |
| 4,164,631 | A | 8/1979 | Garner et al. | | |
| 4,436,179 | A * | 3/1984 | Yamamoto | E01F 8/0041 | 104/124 |
| 4,852,682 | A | 8/1989 | Benjamin | | |
| 4,858,720 | A * | 8/1989 | Murase | G10K 11/30 | 181/175 |
| 6,581,719 | B2 * | 6/2003 | Adamson | G10K 11/26 | 181/182 |
| 7,278,513 | B2 * | 10/2007 | Brawley, Jr. | H04R 1/345 | 181/187 |
| 7,735,599 | B2 | 6/2010 | Kubota | | |

FOREIGN PATENT DOCUMENTS

| | | | | | |
|---|---|---|---|---|---|
| JP | 02136407 | A * | 5/1990 | E01F 8/0041 | |
| JP | 04001311 | A * | 1/1992 | | |
| KR | 20110012496 | A * | 2/2011 | G10K 11/16 | |

* cited by examiner

ACOUSTIC LENS FOR SAFETY BARRIERS

CROSS REFERENCE TO RELATED APPLICATIONS

Pursuant to 35 U.S.C. § 119(e), this application is entitled to and claims the benefit of the filing date of U.S. Provisional App. No. 63/126,175, filed Dec. 16, 2020, the content of which is incorporated herein by reference in its entirety for all purposes.

BACKGROUND

With the onset of the Covid-19 virus, it became necessary to protect workers who need to work in close proximity to other people. One method to protect the people is to separate people by using barriers to prevent the virus-carrying aerosol from reaching the other person. A problem with using a barrier is that it blocks or at least can significantly attenuate the transmission of sound. Sound can refract around the edge of the barrier, but while low frequencies can bend around the barrier, higher frequencies have more difficulty bending. Therefore, the higher the frequency the less that sound is heard. For human speech this means that the components of speech that carry much intelligibility, which includes most consonants, is weaker than if there was no barrier. In addition, the speakers may be wearing a mask. A mask attenuates the high frequencies more than low frequencies. For most listeners this makes the sound of the speech less clear and crisp and less intelligible. Further, since the listener cannot see the talker's lips move, the listener has little side information to use to provide context for the sound heard by the listener, further decreasing the intelligibility. All this causes the people to try to talk to the side of the barrier, which defeats the purpose of the barrier.

One method would be to put a speakerphone on each side of the barrier. This has been used in numerous situations a long time before the problems of a transmissible virus. A disadvantage of using a speakerphone is that the electronics requires power, the electronics can be expensive, and there will be two sounds heard: one from the loudspeaker and another from the talker's actual mouth.

BRIEF DESCRIPTION OF THE DRAWINGS

With respect to the discussion to follow and in particular to the drawings, it is stressed that the particulars shown represent examples for purposes of illustrative discussion and are presented in the cause of providing a description of principles and conceptual aspects of the present disclosure. In this regard, no attempt is made to show implementation details beyond what is needed for a fundamental understanding of the present disclosure. The discussion to follow, in conjunction with the drawings, make apparent to those of skill in the art how embodiments in accordance with the present disclosure may be practiced. In the accompanying drawings.

DETAILED DESCRIPTION

Embodiments of the present disclosure describe a system and method to improve intelligibility of speech when a talker is separated from the listener by a safety barrier such as a clear plastic wall used to protect each person against aerosol from human breath that might carry a virus.

The present disclosure uses acoustic means to bend sound around the edge of the barrier. Embodiments of the present disclosure generally provide an acoustic lens which can be mounted at the edge of a barrier (e.g., top edge), which preferentially guides high frequency sound around the edge of a barrier so that a listener hears the talker much more clearly and with a higher level of intelligibility.

The present disclosure provides an economical and practical method of bending sound around a barrier in the frequency range that will allow for improved listening while safely protecting the humans from aerosol created by their breathing and talking.

In the following description, for purposes of explanation, numerous examples and specific details are set forth in order to provide a thorough understanding of the present disclosure. It will be evident, however, to one skilled in the art that the present disclosure as defined by the claims may include some or all of the features in these examples alone or in combination with other features described below and may further include modifications and equivalents of the features and concepts described herein.

A protective barrier should be designed with no openings (or minimal opening at the bottom) to block the transmission of aerosol from one person to another. The barrier should be high enough that the tallest people will not simply expel their breath over the top of the barrier. The barrier should be sufficiently high that even small amounts of aerosol are not able to make it over the top. There should be enough height so that movement of air, such as from a fan or ventilation will not force the aerosol over the top of the barrier. Therefore, an effective barrier will be significantly higher than the mouth of the tallest talker.

Figure 1:
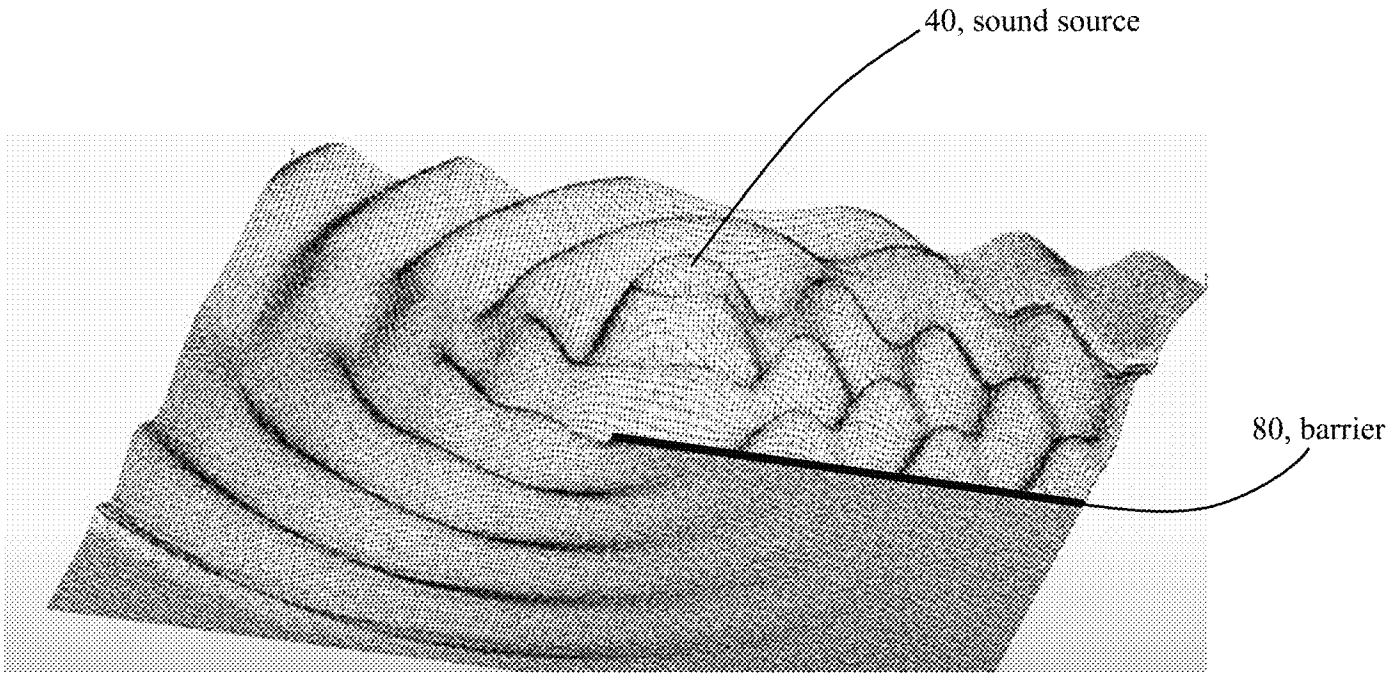
FIG. 1 shows how sound propagates around a barrier.

A problem with a tall protective barrier is that it will block sound. FIG. 1 shows how sound from a source 40 propagates around a barrier 80. The attenuation of sound is dependent on frequency. When the distance of the listener (or measurement microphone) is larger than the wavelength, the attenuation is approximately proportional to the frequency. For frequencies where the distance of the listener is much less than the wavelength, then the sound is barely attenuated at all. At higher frequencies, where the distance of the talker and listener relative to the barrier is larger than the wavelength, there will be significant attenuation. When there is a barrier, a representative frequency response for a typical barrier can be:

0 dB at 500 Hz
−3 dB at 1000 Hz
−9 dB at 2000 Hz
−15 dB at 4000 Hz, and
−21 dB at 8000 Hz.

Since the frequencies above 1000 Hz carry most of the intelligibility information, it can be appreciated that the barrier has a severe effect on the intelligibility of the voices. If the frequencies above 1000 Hz could be amplified, then it will be much easier for the listener to understand what the talker is saying.

Embodiments in accordance with the present disclosure provide a means of bending high frequency sounds, above 1 kHz, around the barrier. This can be accomplished by utilizing curved acoustic sheets of acoustically opaque material to delay sound by creating acoustic channels of different path lengths. In accordance with some embodiments of the present disclosure, for example, an acoustic lens uses 4 sheets, although other embodiments can use 3 sheets or even 2 sheets.

Figure 2A:
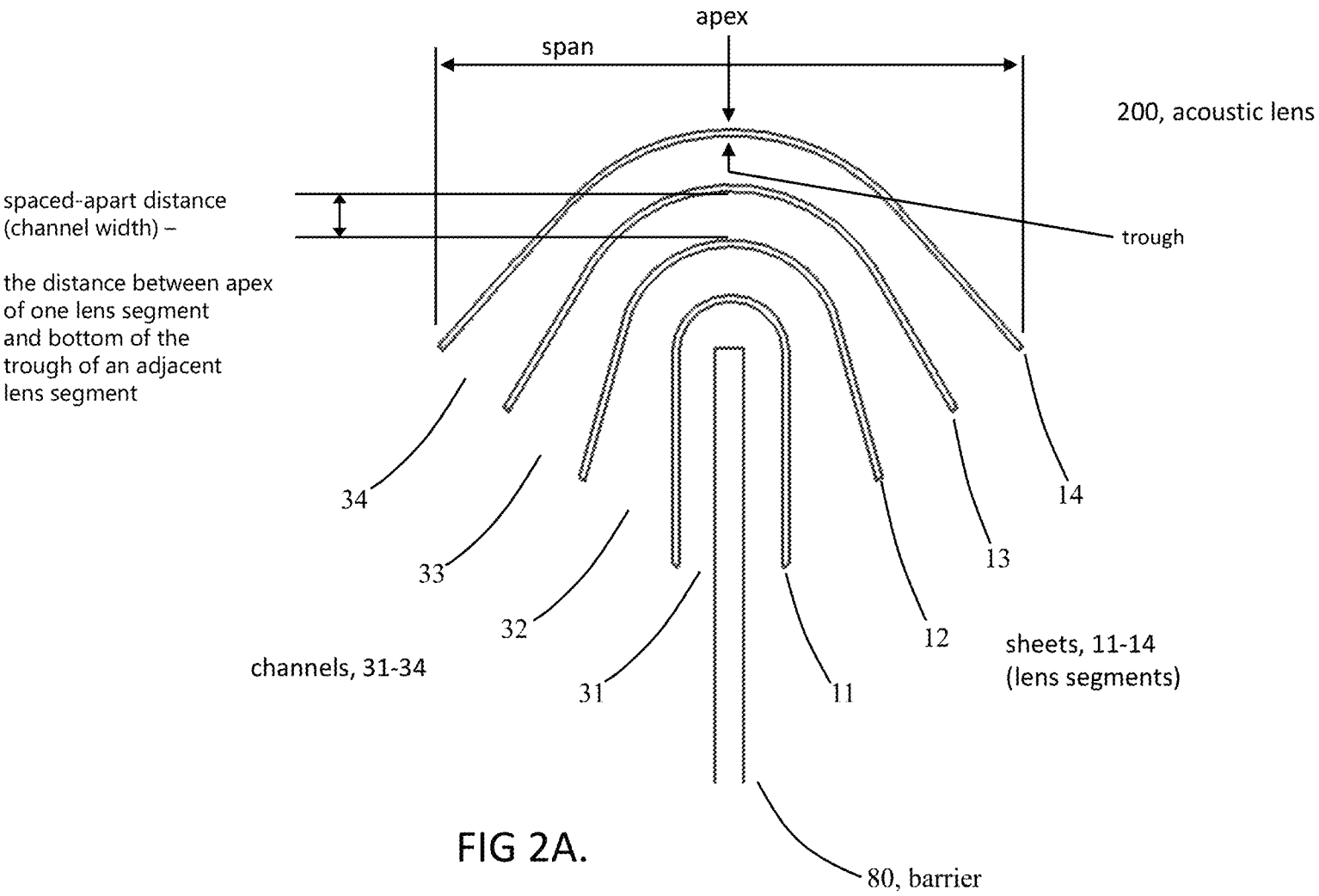
FIGS. 2A and 2B show a cross section of the structure of the acoustic lens.

FIG. 2A shows, in a cross section orthogonal to the barrier 80, an acoustic lens 200 in accordance with the present disclosure comprising a plurality of sheets 11-14. In some embodiments, each sheet can be rectangular and has a sheet length and a sheet width. The sheets are conformed or otherwise manipulated to form acoustic lens segments having an arch-shaped cross section. The lens segments are in a stacked and spaced-apart arrangement relative to each other to form channels between the lens segments. The sheets are space-apart by a distance that is defined as the distance between the apex of one sheet and the trough of an adjacent sheet. The innermost lens segment (e.g., 11) has a substantially U-shaped cross-section. Successive outer lens segments (e.g., 12, 13, 14) have parabolic cross-sections with increasing spans (defined by as the width at the open end of the arch). For brevity, we can refer to acoustic lens segments as "sheets."

Figure 2B:
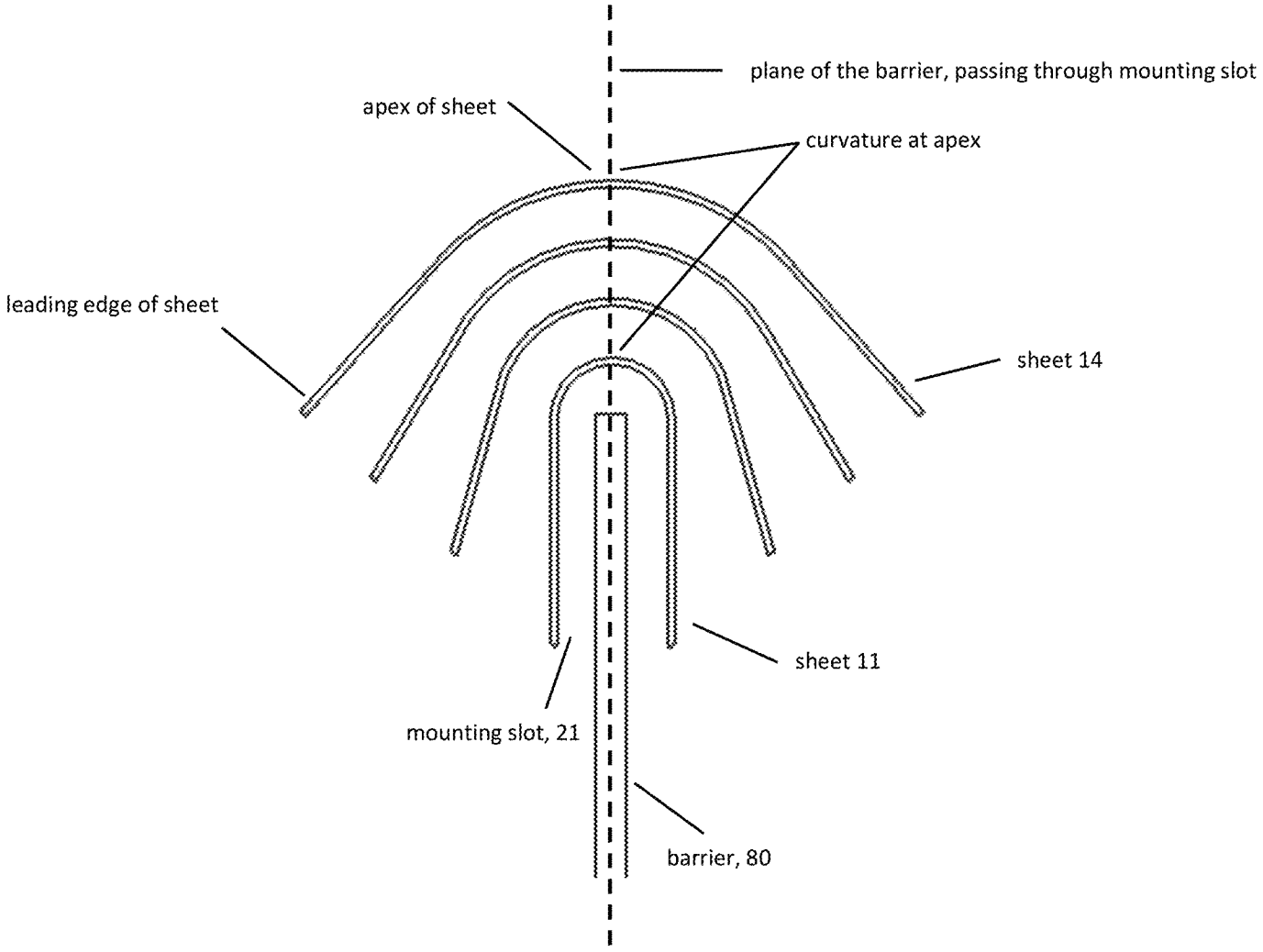

In some embodiments, the sheets 11-14 are parallel in cross sections where a plane of the barrier passing through the mounting slot intersects the sheets (see FIG. 2B, for example). The first sheet 11 in FIG. 2A forms a cross section that is nearly a U-shape. It creates a first channel 31, which is formed by the barrier 80 and the first sheet 11, for sound to travel.

The acoustic lens 200 straddles the barrier 80 so that the longitudinal edges of the sheets 11-14 (see FIG. 3) lie on each side of the barrier.

Figure 3:
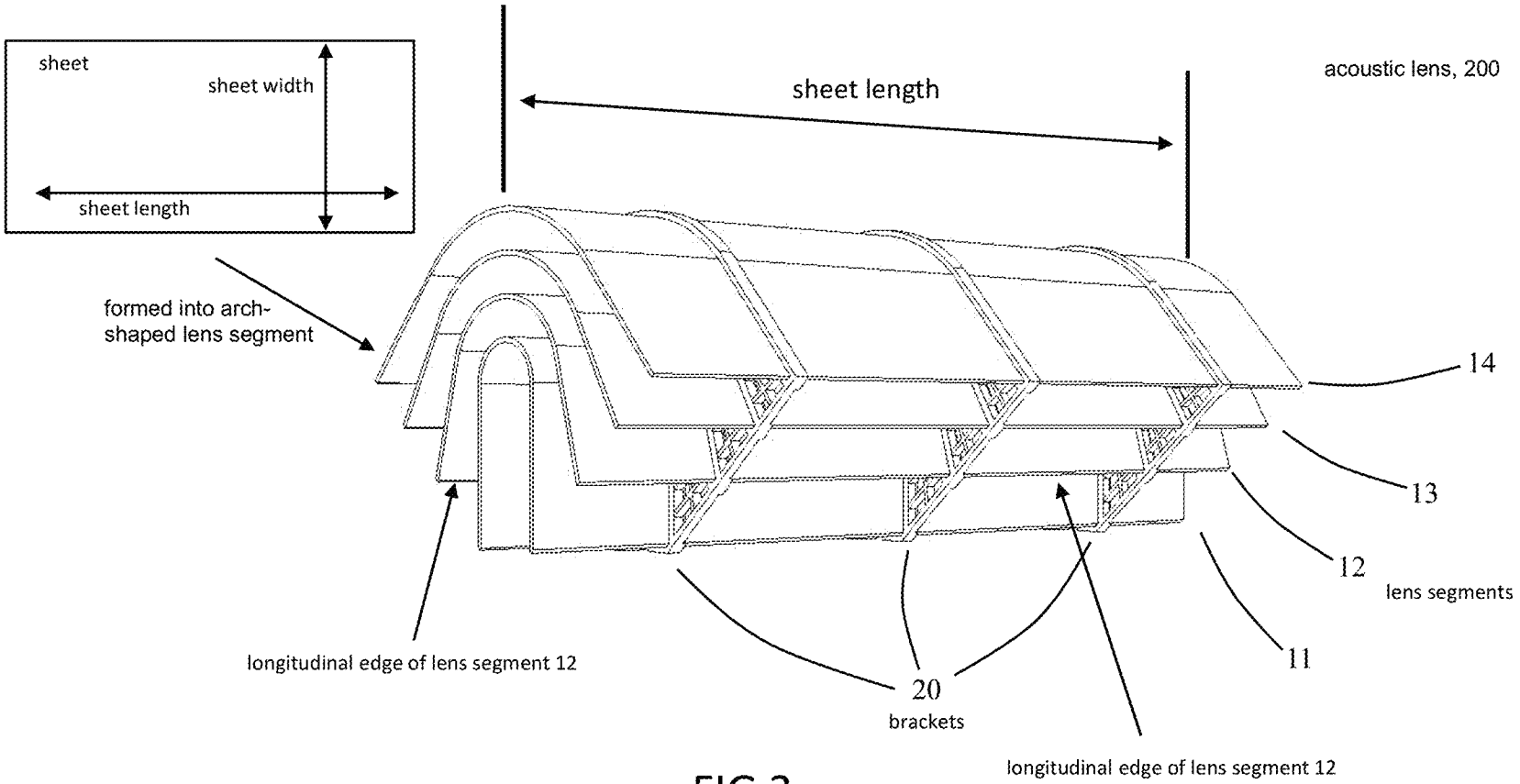
FIG. 3 is a perspective view of the acoustic lens.

A perspective view of the acoustic lens 200 is shown in FIG. 3. The spacing between the sheets 11-14 form respective channels 32, 33, 34 (FIG. 2A) for the sound to travel. There is a channel 31 that is formed by the barrier itself and the first inside sheet, so the total number of channels is equal to the number of sheets.

Figure 4:
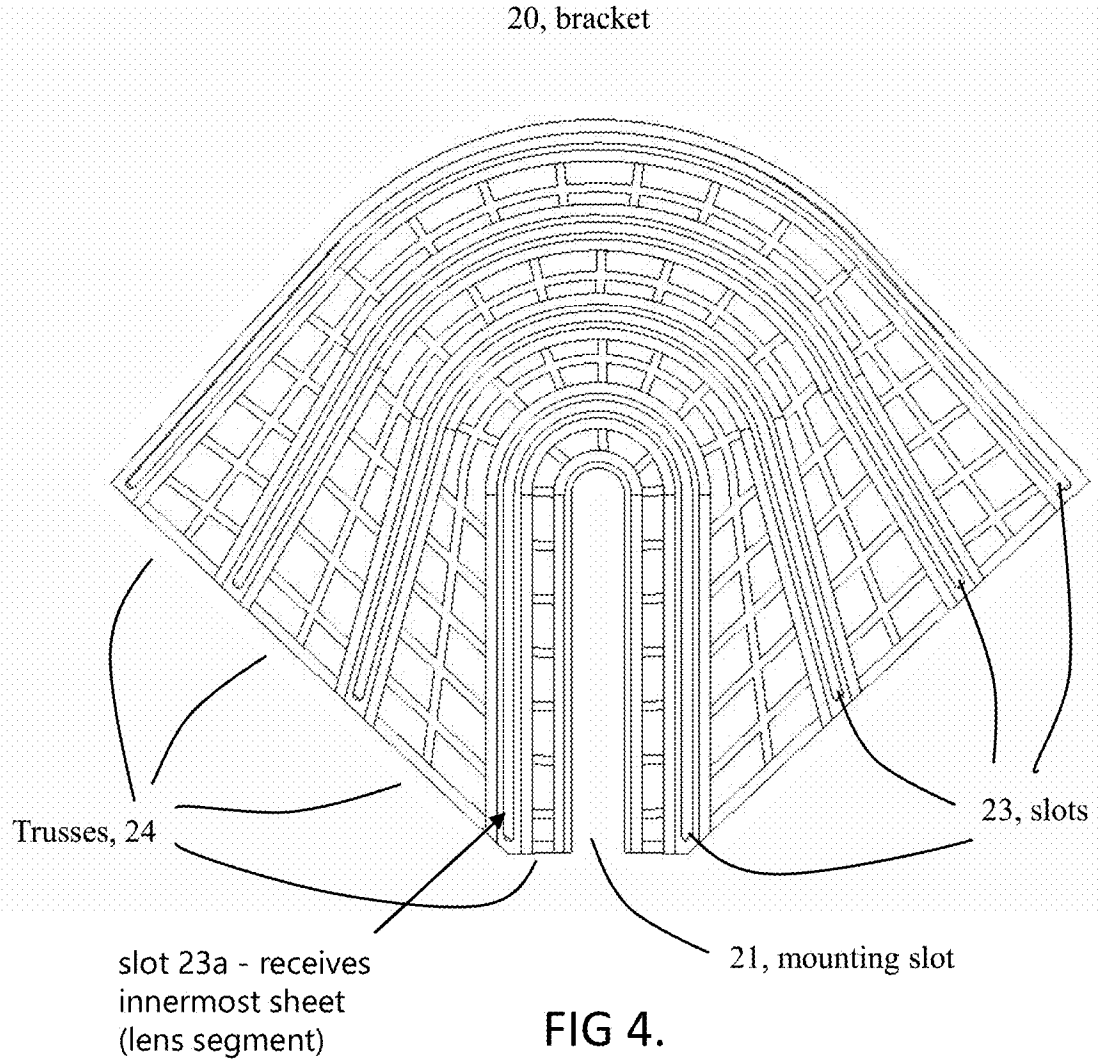
FIG. 4 shows a side view of a representative bracket that holds the sheets of acoustically opaque material.

The sheets are held in spaced-apart relation from each other by brackets 20. An illustrative bracket 20 in accordance with some embodiments is shown in FIG. 4. Bracket 20 includes slots 23 to receive sheets 11-14, a mounting slot 21 to accommodate the barrier, and truss regions 24 to support the sheets in position and to allow for sound to travel without significant interference from the bracket. The truss area 24 consists of a structure with struts to give the bracket strength while allowing for sound to move through the truss.

Figure 5:
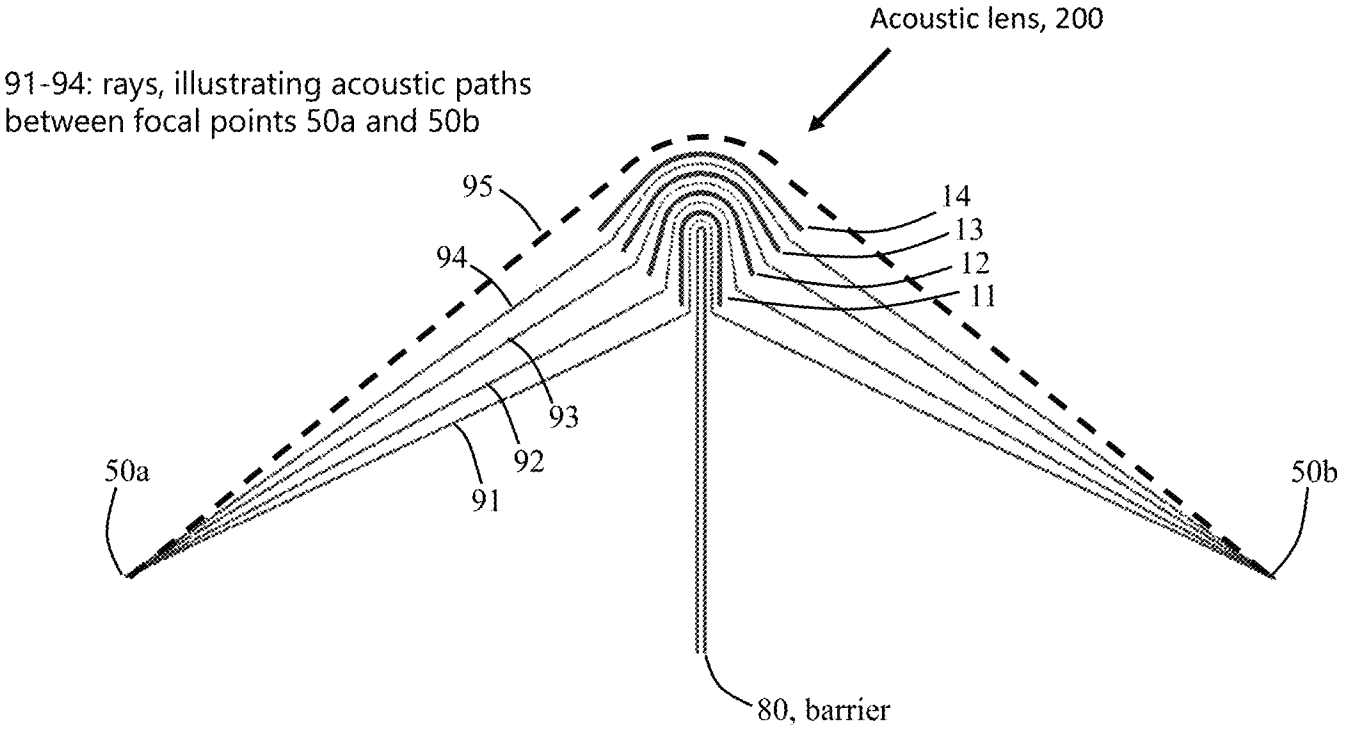
FIG. 5 shows a ray tracing analysis to illustrate focal points of the acoustic lens.

Embodiments of an acoustic lens in accordance with the present disclosure create different path lengths for the channels to refocus the sound while bending the sound. To refocus the sound, the concept of a focal point is used. Referring to FIG. 5, since it is not predictable where the talker and listener may be located, the typical design of acoustic lens 200 can position the focal points 50*a*, 50*b* further away from the barrier 80 than the likely positions of the typical talker and listener positions. To focus the sound, a requirement is that the distance the sound travels from a focal point on one side of the barrier to a focal point on the other side be the same for each channel. Using ray tracing as shown in FIG. 5, the distance for each channel is equal to the distance from the focal point 50*a* to the entry of the channel plus the distance the sound travels inside the channel plus the distance on the other side to the opposite focal point 50*b*. FIG. 5 shows four acoustic paths between focal points 50*a* and 50*b*, represented by rays 91, 92, 93, 94. In the case of a symmetric lens (where the plane of the barrier intersects each constituent sheet at its midpoint), it is only necessary to guarantee the distances match to the midpoint of the lens which is also the point where the wall would intersect with the lens if the wall were extended.

Referring for a moment to FIG. 2B, a characteristic of the lens, in order to bend sound downward, is that the innermost rib and hence the innermost sheet (e.g., sheet 11) has the most (highest) curvature at its apex as compared to the other sheets and that the curvature at the apex point is progressively less for each sheet from innermost to outermost, where the outermost rib and hence the outermost sheet has the least curvature at its apex. Accordingly, brackets in accordance with the present disclosure for supporting the sheets include corresponding guides (e.g., slots 23, FIG. 4) to maintain the sheets in proper curvature relative to each other. The brackets having holding features that define planar curves which are projected to the length of the sheet. The characteristics of the planar curve is 1) the curvature at the apex of a sheet comprising is the greatest and the curvature is the least at the leading edge of the sheet, 2) the curvature of the sheet is downward, 3) the curvature at the apex of the innermost sheet is the greatest relative to the other sheets, and the curvature at the apex is progressively less for each sheet from innermost to outermost.

Figure 6:
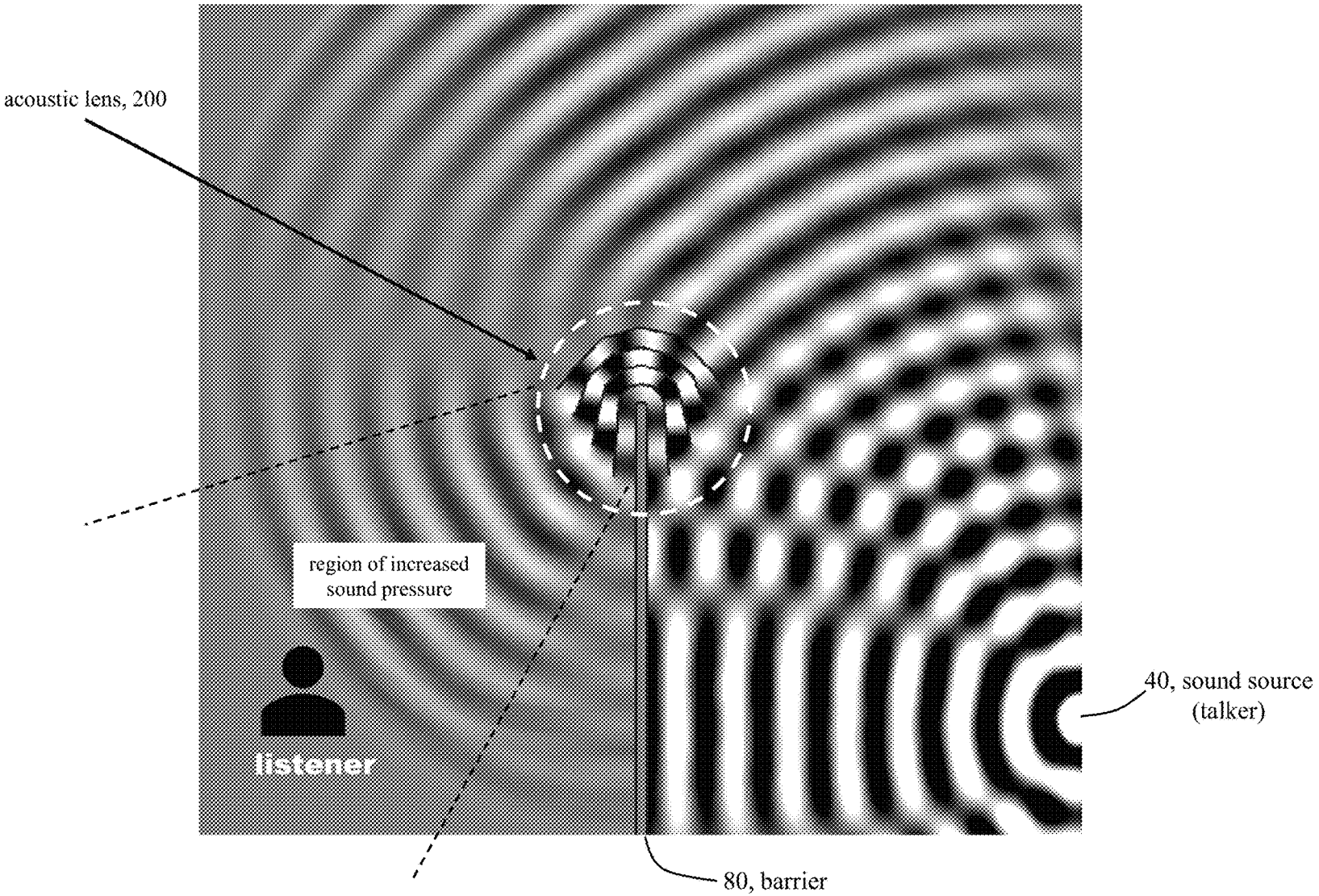
FIG. 6 shows a two-dimensional simulation of sound propagating from one source through the lens.

Referring to FIG. 6, the talker's mouth is approximately a point source. However, it is not necessary for the sound from the point source to be refocused to a singular focal point on the other side, but using focal points is a design method that provides a good result. For typical usage, the talker will be closer than the focal point, so the sound from the talker will not focus to a single point, but the sound will have greater intensity than if there were no lens.

In common voice telephone systems, the speech transmission is band limited to frequencies between 200 to 3400 Hz. For more modern systems such as Voice over IP, or videoconferencing, the transmitted frequencies go up to 7000 Hz. It is generally accepted that most of human speech energy is represented by sounds below 7000 Hz and good intelligibility is achieved with sound transmitted below 3400 Hz. Accordingly, good performance can be achieved when an acoustic lens in accordance with the present disclosure is effective through 3400 Hz and even better if effective up to 7000 Hz. Referring to FIG. 2A, in accordance with some embodiments of the present disclosure the width of the channels at the midpoint (apex) can be set at 2 centimeters while the width of the channels at the entry and exit points can be set slightly greater than 2 centimeters. Two centimeters is 20% of the wavelength of sound at 3400 kHz where the speed of sound is 346 meters per second at room temperature. In order for the sound to travel reliably through the channels the channel spacing is made much less than the smallest desired wavelength. If the spacing is large relative to the wavelength, then the sound will have complex reflections inside the channel and the frequency response will not be reliable. It was determined experimentally that two centimeters is a sufficiently small distance to allow for sound to propagate inside the channels with a relatively smooth frequency response. The shape of the top (outermost) sheet 14 is made to be nearly the same shape as the gradient of the sound that is traveling outside of the lens. A ray 95 is shown in FIG. 5 to represent the sound wave that is traveling around the exterior of the acoustic lens. The shape of the outermost sheet 14 approximates the same contour as the path of the ray 95. This way the sound inside the channels will be nearly in phase with the sound traveling around the entire device. This will preserve the intensity of the sound by avoiding destructive interference of the sound from the lens interfering with sound that travels over the top of the lens.

The sheets 11-14 can be made of metal, or plastic, or card stock or any other acoustically opaque material that can be made into a sheet. The sheet material should not be so flimsy that sound will go through the material. That is, the material should be acoustically opaque and not acoustically transparent. Card stock is generally the most economical material and if it is thick enough it will be substantially acoustically opaque. An advantage of embodiments in accordance with the present disclosure is that the card stock can be easily colored or printed on to provide branding, or to label an area. The sheet material, although acoustically opaque, can be optically transparent; for example such as clear polycarbonate. Clear sheets can be useful, for instance, in places such as coffee shops where the lens would be in line of sight between the customer's eyes and the menu board.

The acoustic lens includes brackets 20 to hold the sheets in place and to form a bend (arc) in the sheets. In the case of card stock, the card stock does not have to be pre-shaped but can be simply inserted into slots 23 of the bracket 20. For other materials such as plastic or metal the sheets can be shaped as part of the manufacturing process. In principle, the bracket can be simplified if the sheets are able to support themselves.

Figure 12:
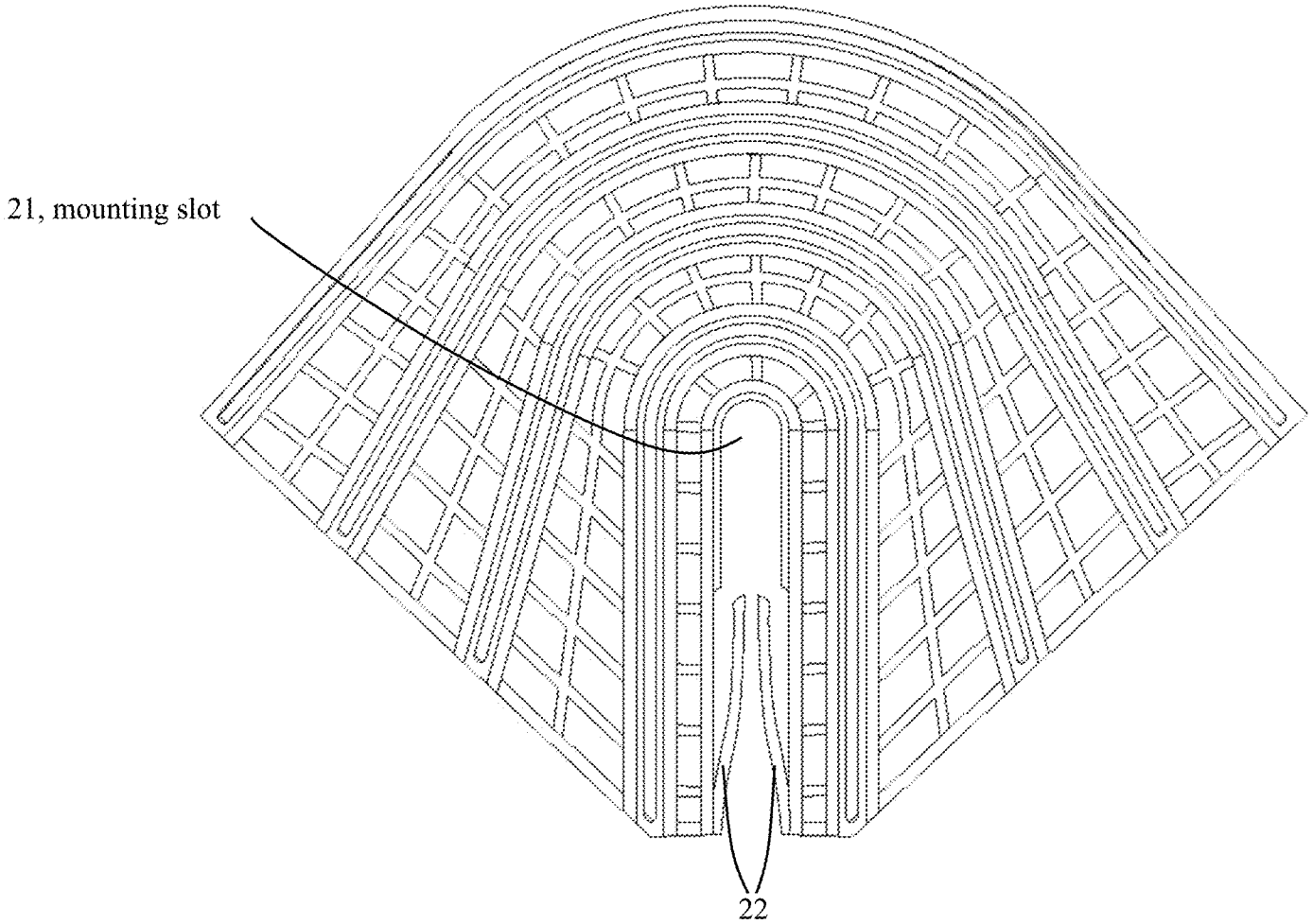
FIG. 12 shows a side view of a bracket for gripping the barrier with flexible fingers before the lens is placed onto a barrier.
Figure 13:
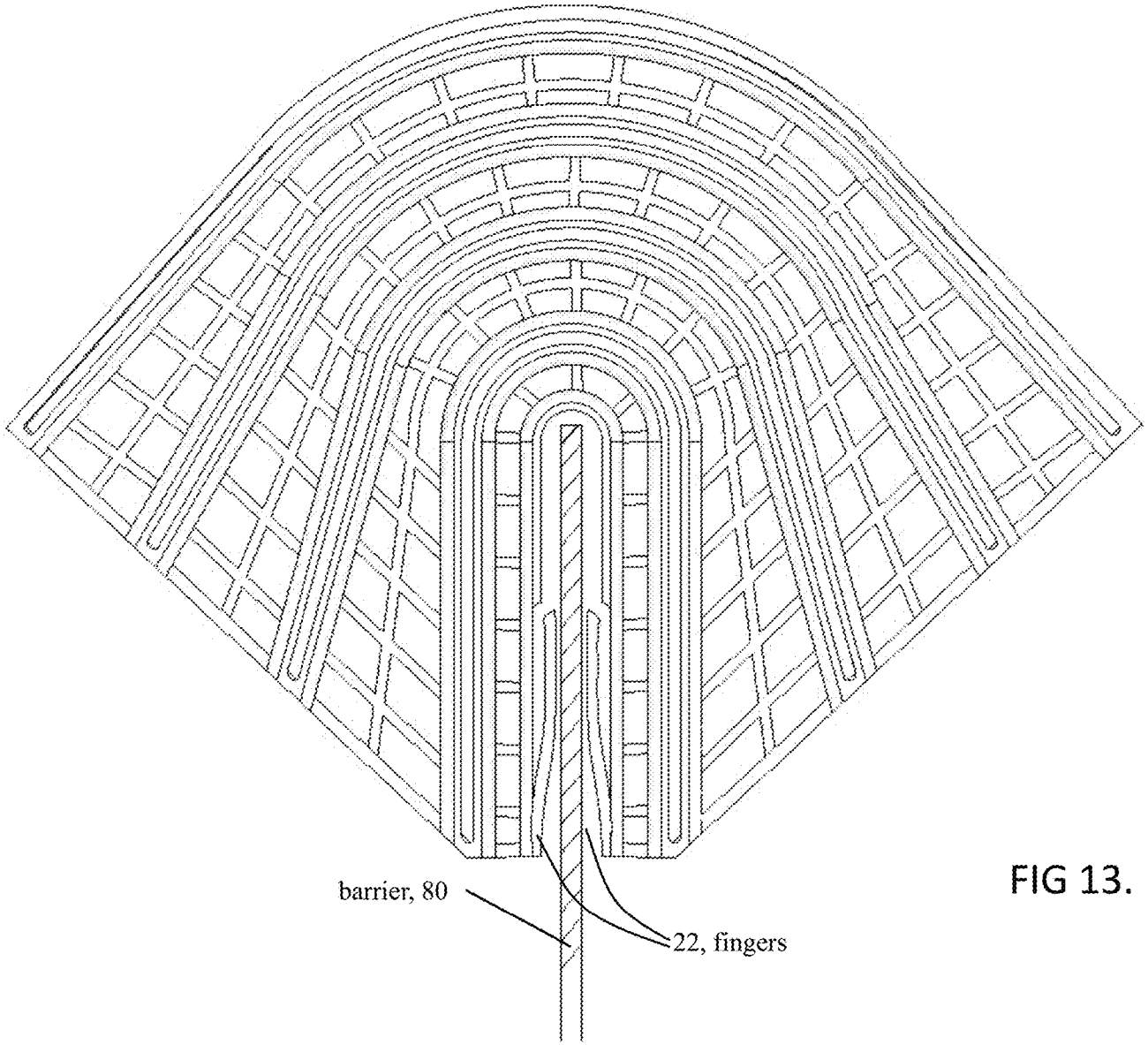
FIG. 13 shows a side view of a bracket for gripping the barrier after the lens is placed onto the barrier displacing the fingers.

The barriers on which the acoustic lens is attached can vary in thickness. In addition, the barrier may have a border or frame attached to the edge of the barrier. Brackets in accordance with the present disclosure can be designed to flex when the lens is placed on top of the barrier. Referring to FIGS. 12 and 13, for example, in some embodiments, the bracket 20 can have bendable fingers 22 that take up space and apply pressure to the barrier 80 to keep the lens upright. The top of the mounting slot 21 has an upside-down V or U shape to allow the device to self-center on the barrier.

Figure 7:
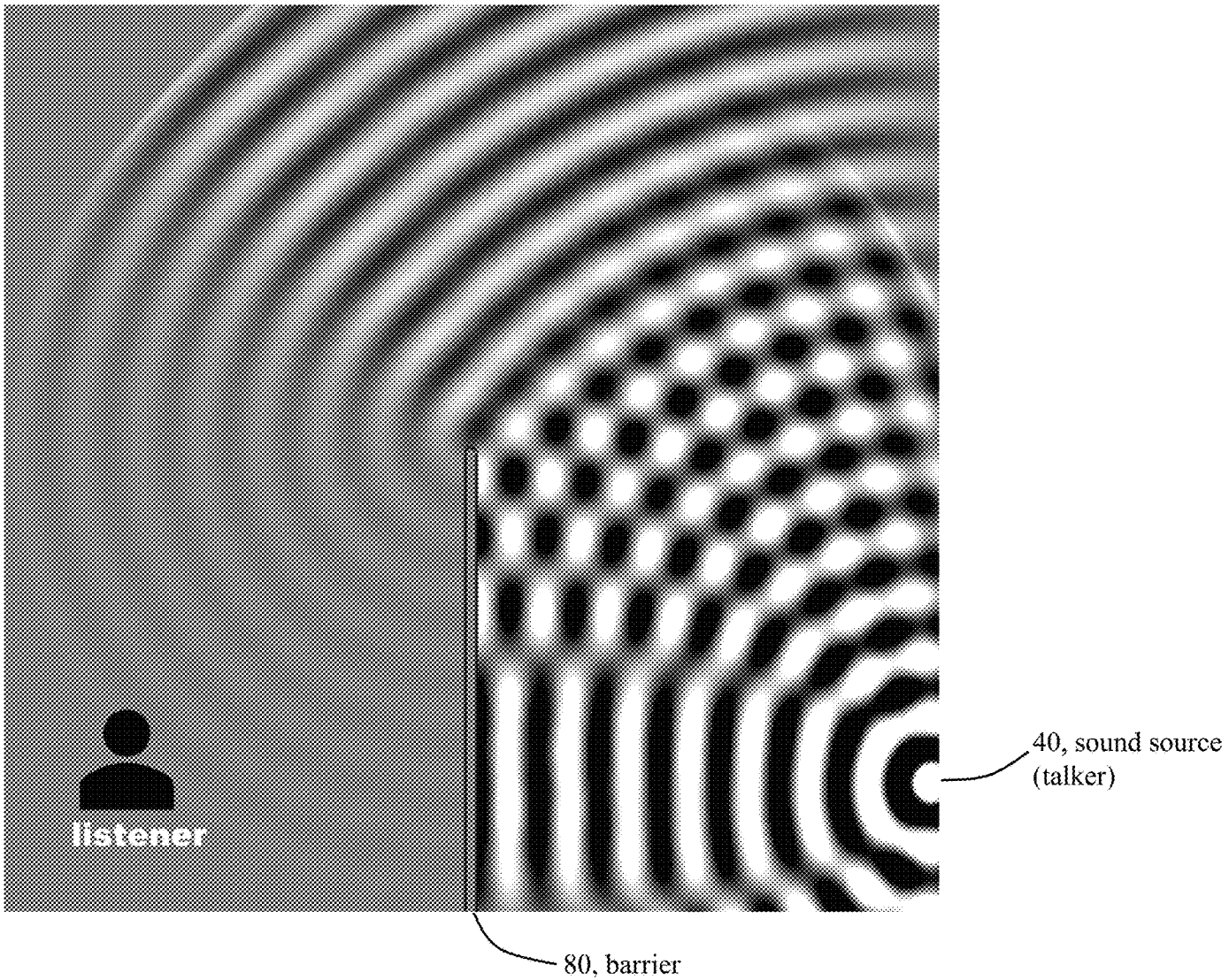
FIG. 7 shows a two-dimensional simulation of sound propagating from one source through without the aid of the acoustic lens.

FIG. 6 shows a two-dimensional simulation of sound propagating from sound source 40 through the acoustic lens 200. FIG. 6 shows the acoustic lens creates a region of increased sound pressure. The figure shows that the acoustic lens can effectively direct sound from the talker to the listener when the listener's position coincides with the region of increased sound pressure. Compare this illustration of the sound in FIG. 7 where there is only a barrier 80 and no acoustic lens. There is no region of increased sound pressure. The sound that reaches the listener is significantly attenuated regardless of the listener's position behind the barrier. It is apparent that the sound intensity is greatly improved by the presences of the acoustic lens 200.

Figure 8:
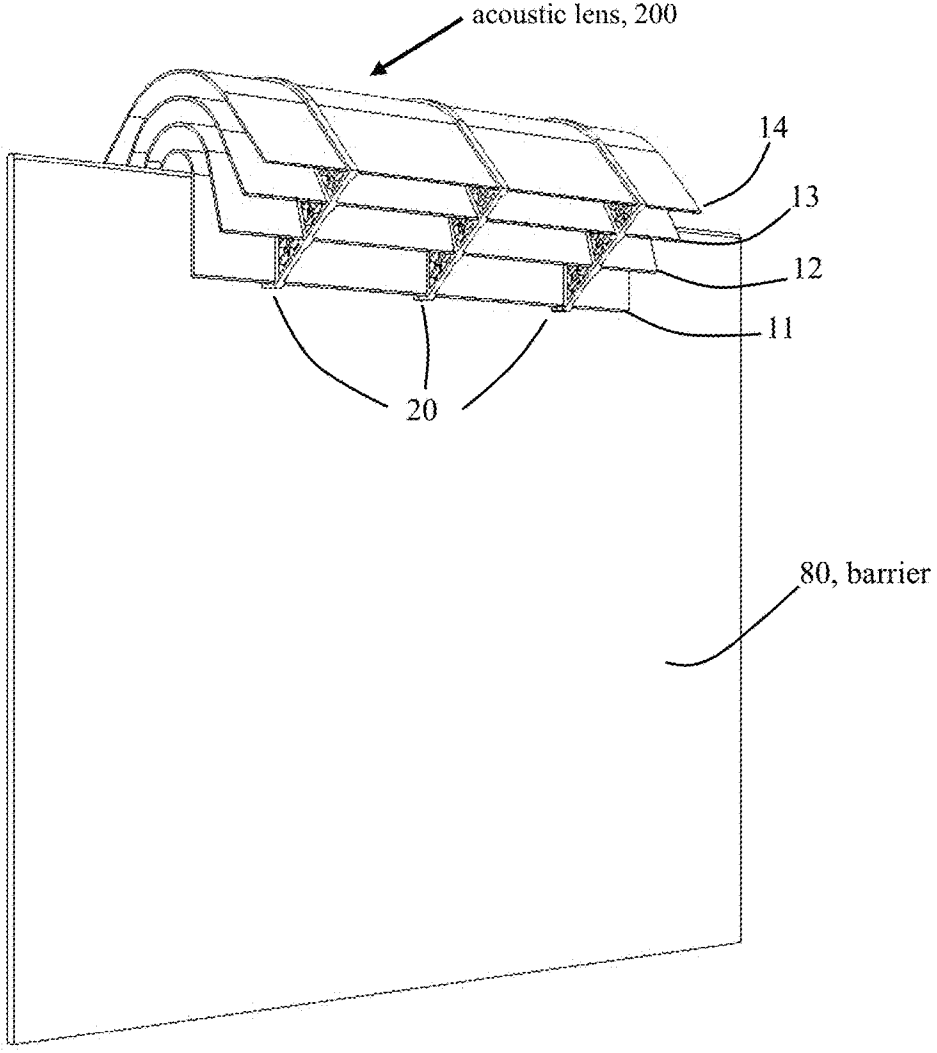
FIG. 8 shows a perspective drawing of the acoustic lens mounted on a barrier.

FIG. 8 shows a perspective drawing of the acoustic lens 200 mounted on a barrier 80.

Figure 9:
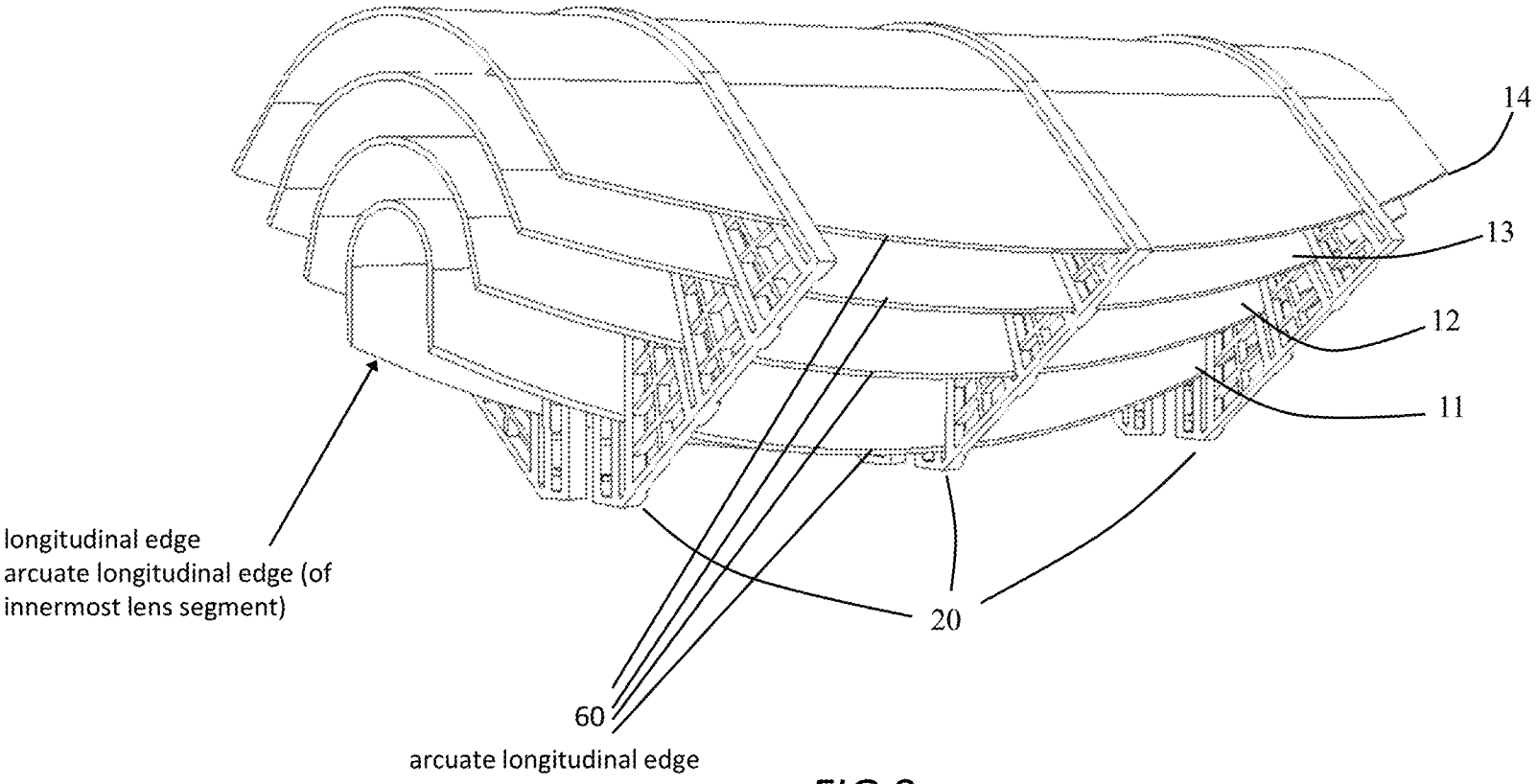
FIG. 9 is a perspective view of the acoustic lens with the front edge of the sheets trimmed to shape the leading edge of the sheets.

Up to this point embodiments, as described, allow for the talker and listener to be positioned in a variety of positions side to side. The lens action acts vertically. This allows for a situation where the talker and listener are not standing directly across from each other. An example would be a barrier at a grocery check stand. The customer and the clerk may not be directly across from each other. In this situation, there may be several sections of the lens concatenated together so that there is no requirement for where the talker and listener are standing. There are also situations where the talker and listener are directly across from each other. For example, in a bank the customer steps up in front of a teller. In some embodiments, the acoustic lens can be made to bend the sound horizontally. To accomplish this, the sheets can be trimmed to form arcuate longitudinal edges 60 as shown in FIG. 9. Since the channels are shorter near the ends of the lens, the distance the sound travels through the channels is shorter on the ends than in the center. This has the effect of focusing the sound horizontally and slightly upward. The front and rear edges of the are trimmed to form arcs 60.

Figure 10:
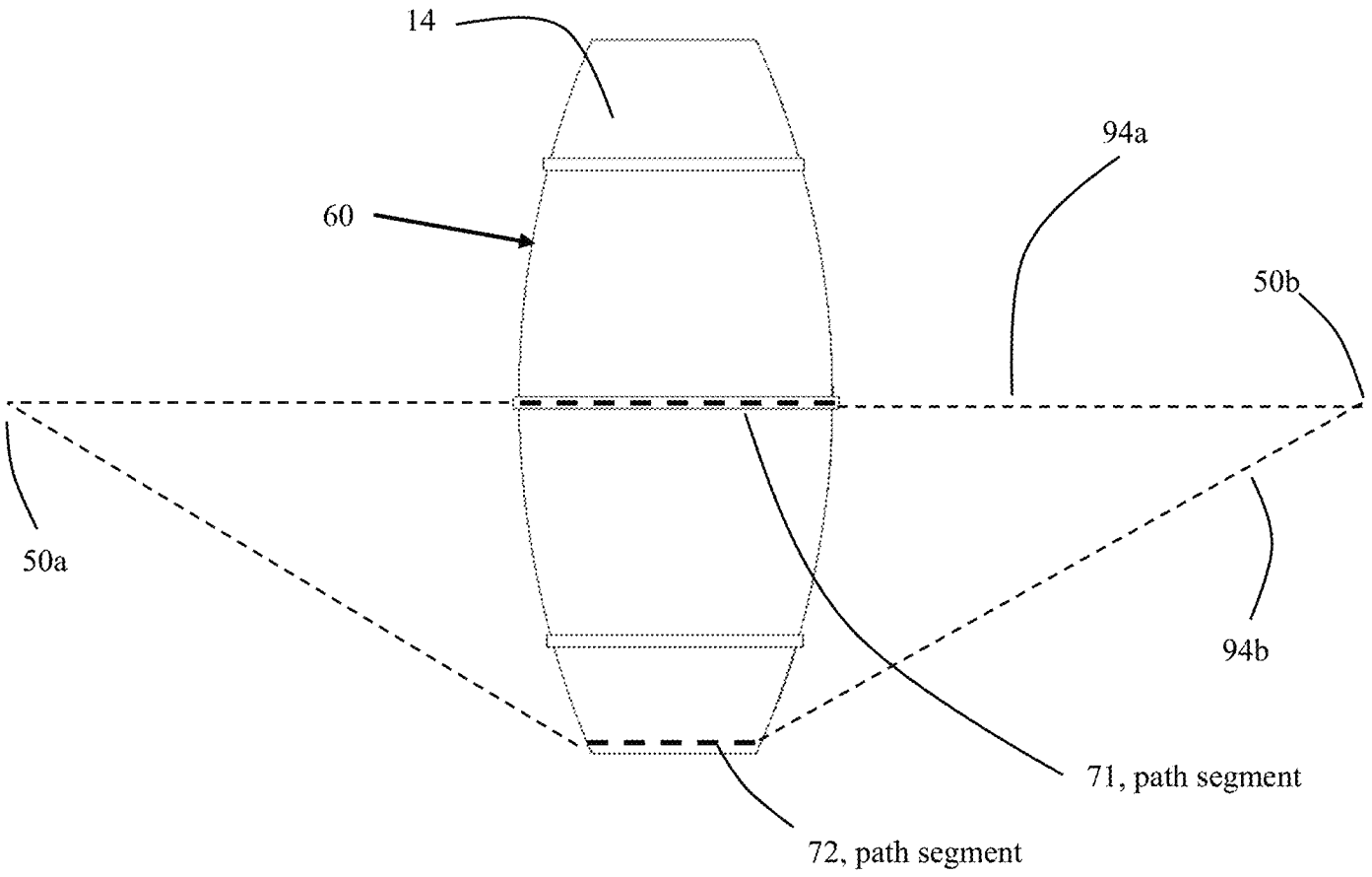
FIG. 10 shows a horizontal analysis of ray tracing to show the focal points in the horizontal dimension where the front edges of the sheets are trimmed to shape the leading edge of the sheets.
Figures 11A, 11B:
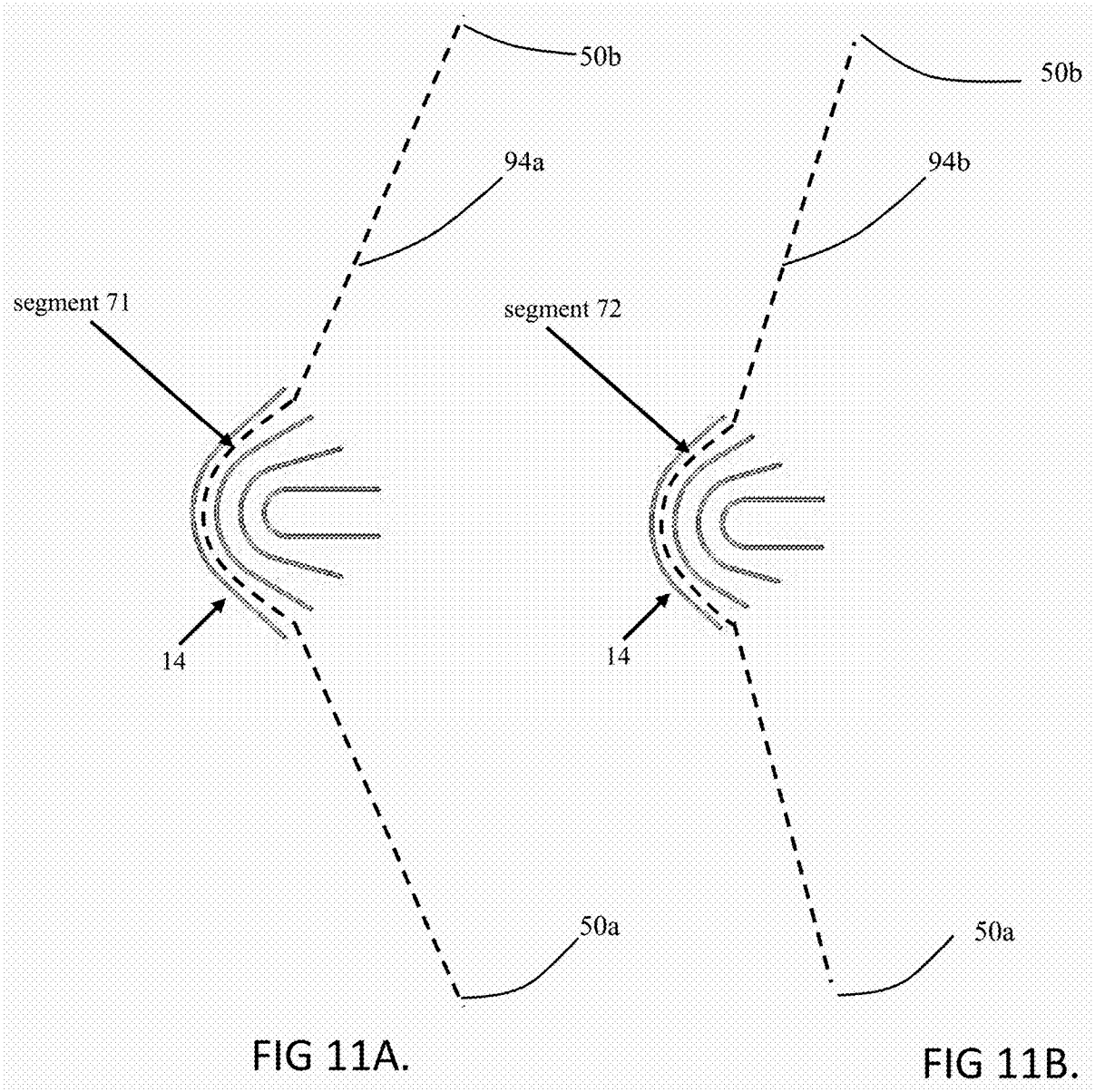
FIGS. 11A and 11B show a vertical analysis of ray tracing to show different length focal points in the horizontal dimension where the front edges of the sheets are trimmed to shape the leading edge of the sheets.

FIG. 10 shows a top view to show how sound can be focused horizontally. In the figure two rays of sound are traced with one ray 94*a* going through the center of the lens and another ray 94*b* going through the edge of the lens. The segments 71 and 72 show the path through the lens channels. Those segments delay the sound depending on the curvature and length of the channels. The total path length of the rays 94*a* and 94*b* are equal. In FIG. 11A we show a side view showing the path 94*a* through the center of the top channel and in FIG. 11B we show the path 94*b* through the side edge of the top channel. This is a projection of the path of 94*b*. The segment 72 of the path of 94*b* inside the channel is shorter than the segment 71 of the path 94*a* inside the channel to compensate for the longer portions of path 94*b* that are exterior of the channel.

For the lens to fit securely onto a variety of barrier thicknesses, the bracket of the lens system is designed with a feature to grip the barrier. In FIG. 12 are shown flexible fingers 22 to grip the barrier on each side. When the lens is pushed down on the barrier, the flexible fingers are displaced to the width of the barrier and the fingers apply pressure against the barrier to keep the lens centered on the barrier. The top of the mounting slot can be shaped with an inverted U or V shape so that the weight of the lens keeps the lens centered at the top of the mounting slot. FIG. 13 shows how the barrier is gripped by the fingers and held in place by the inverted U shape formed at the top of the mounting slot.

Figure 14A:
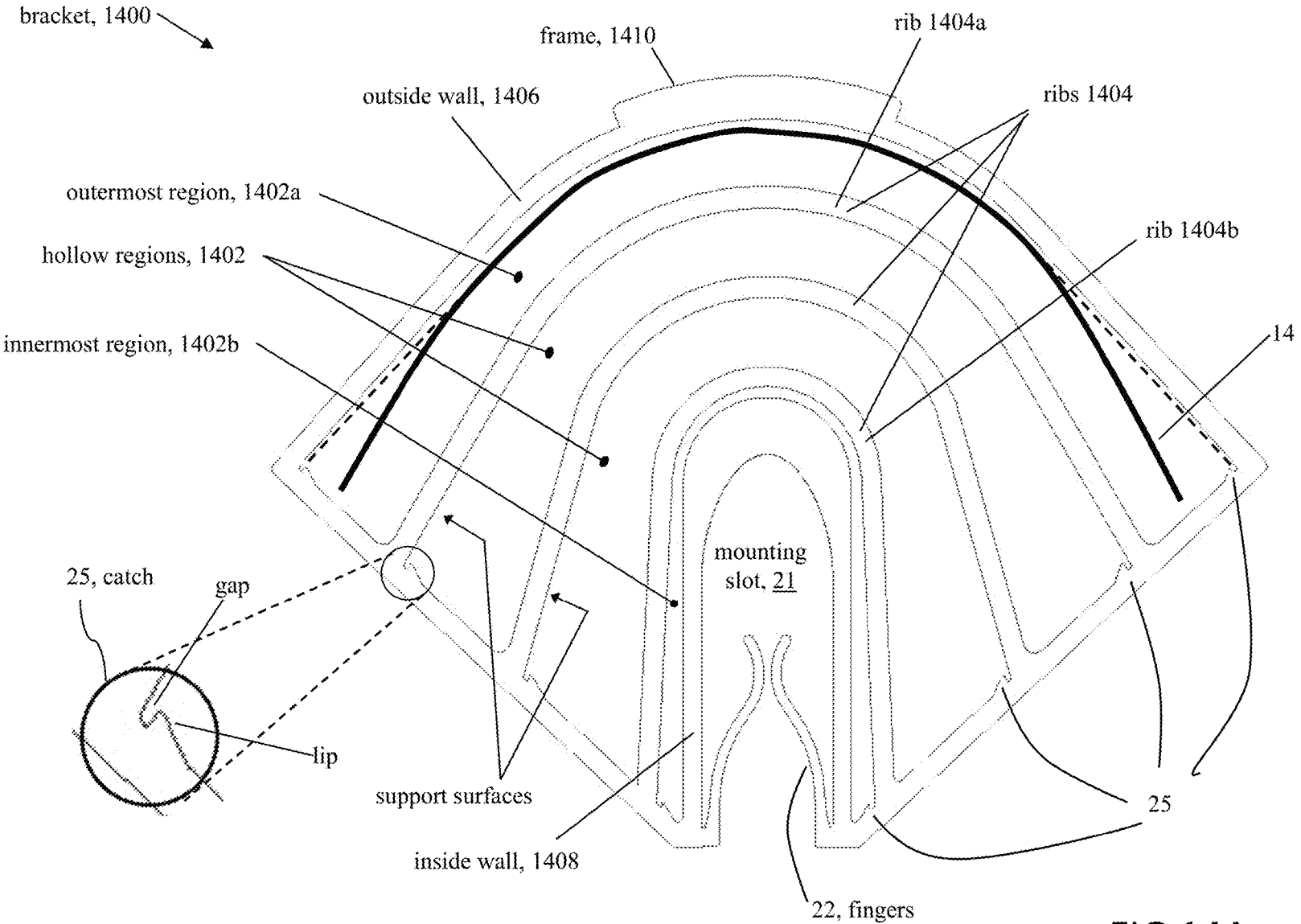
FIG. 14A shows an alternate design of a bracket with reduced material showing a sheet position before it is snapped into place.
Figure 14B:
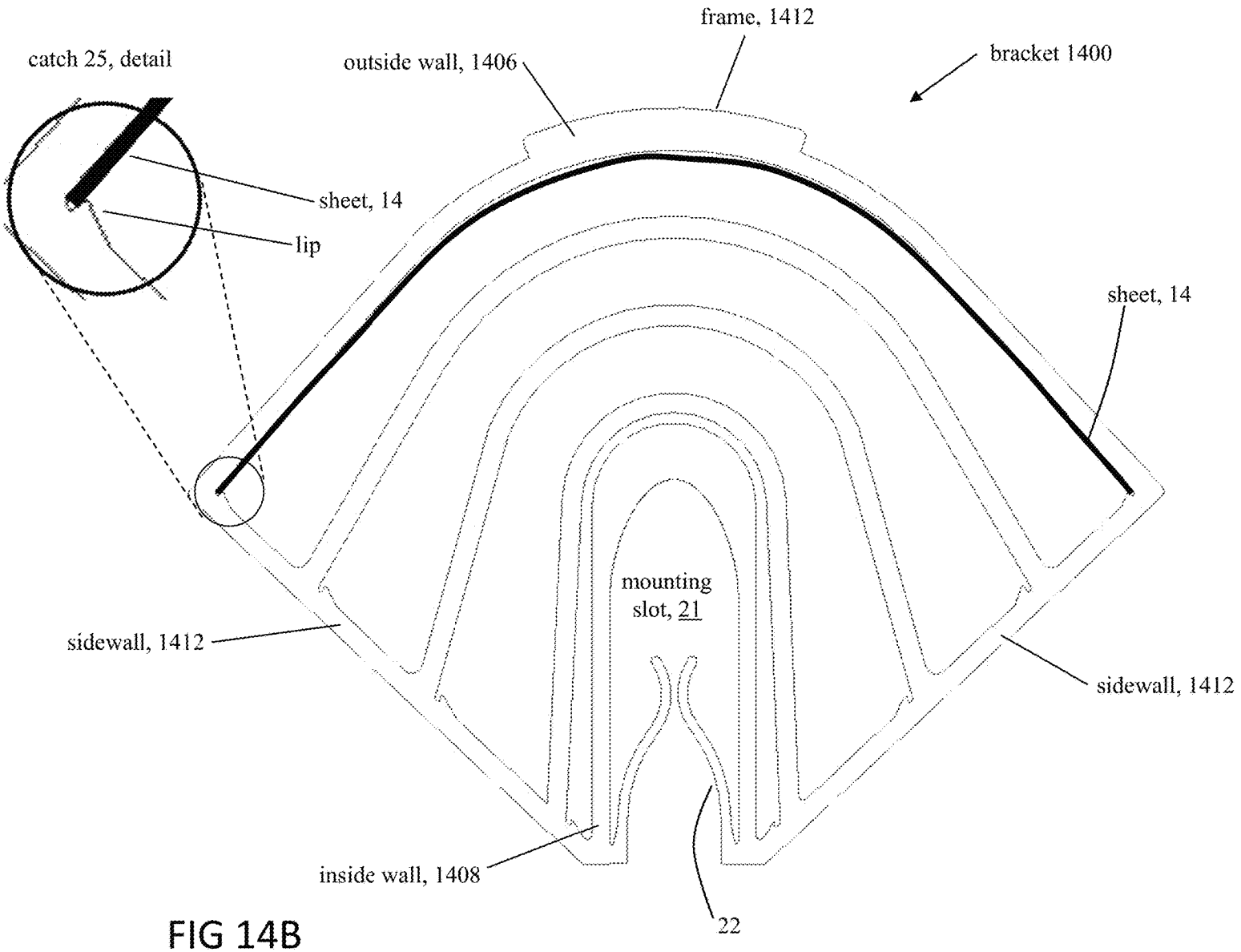
FIG. 14B shows an alternate design of a bracket with reduced material showing a sheet in position after it is snapped into place.

An alternate bracket design in accordance with the present disclosure is shown in FIG. 14A and FIG. 14B. Bracket 1400 is simplified and more lightweight design as compared to bracket 20 by omitting the trusses 24 (FIG. 4). Bracket 1400 comprises a frame 1410 consisting of an outside wall 1406 and sidewalls 1412 that connect the outside wall to an inside wall 1408. The inside wall 1408 has a U-shaped feature that defines mounting slot 21 for receiving barrier 80. Bracket 1400 includes spaced apart segments (ribs) 1404 that define hollow regions 1402 between the ribs. An outermost hollow region 1402*a* is defined between outside wall 1406 of the bracket and rib 1404*a*. An innermost hollow region 1402*b* is defined between inside wall 1408 and rib 1404*b*.

The inside surface of each rib 1404 has an arcuate, concave, arch-shaped profile. Likewise, the inside surfaces of outside wall 1406 and inside wall 1408 of the bracket 1400 have arcuate, concave, arch-shaped profiles. The arch-shaped profiles of these inside surfaces provide a surface that the constituent sheets of the acoustic lens can press against to support or otherwise hold their curvature, and thus can be referred to as support surfaces.

In accordance with the present disclosure. Catch features 25 can be formed at opposing ends of the support surfaces where the ribs 1404 join to the frame 1410. As can be seen in the magnified view in FIG. 14A, catch 25 can include a lip portion that can be formed from the body of the bracket 1400. The lip portion defines a gap between the lip and the support surface.

The bracket 1400 can be formed as a single piece using known injection molding materials and any suitable injection mold material.

Sheets can be inserted in respective hollow regions 1402 of bracket 1400. FIG. 14A shows a sheet 14 inserted in hollow region 1402*a* between outside wall 1406 and rib 1404*a*, and positioned against the support surface of the outside wall. Each sheet can be secured against a support surface by snapping the sheet into place, for example, by pushing the sheet over the lip portion of catch 25 into the channel. The sheets should be made from sufficiently stiff material so that can stay in place and not buckle at the contact point with the catches 25. The same procedure works for each of the other sheets. FIG. 14B shows details of catch 25 receiving sheet 14 to secure the sheet against the support surface. The areas of the hollow regions 1402 of bracket 1400 allow for a user to easily insert the sheets, and require less material to form the bracket.

Figure 15:
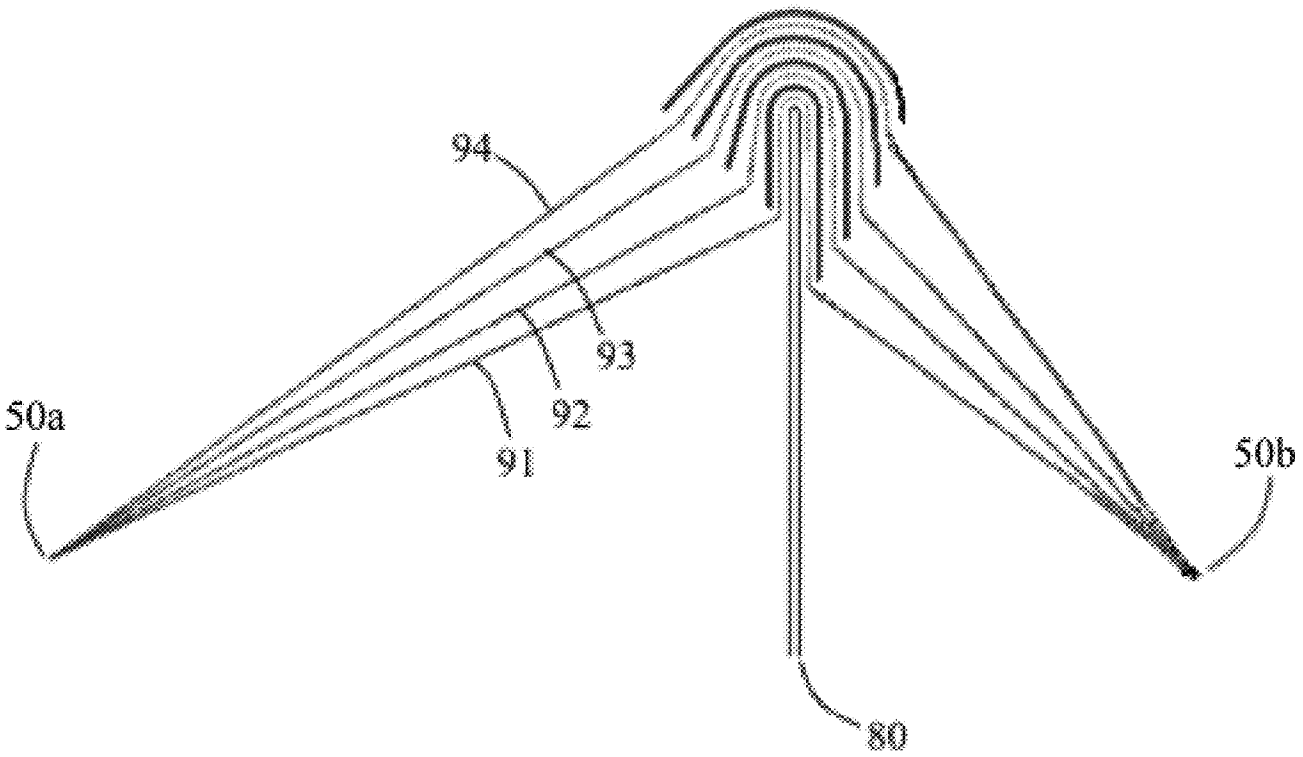
FIG. 15 shows a cross section of an asymmetric acoustic lens.

Up to this point, an acoustic lens has been described which is symmetric on each side of the barrier. However, there are situations where a human may be positioned closer to the barrier 80 on one side of the barrier than on the other side of the barrier. For example, a customer may be likely to stand much closer to the barrier than a clerk who may be separated from the barrier by a counter or desk. In this case, an optimization could be made by making the profile of the lens asymmetric so that the focal point on the customer side is closer to the barrier than on the clerk side. This is illustrated in FIG. 15. On one side the focal point 50*a* is further away from the barrier than the focal point 50*b* on the other side. This is achieved by changing the path lengths inside the channels. On the side with the shorter focal point, the focus is more downward, so this requires a greater difference between the channel closest to the barrier 91, and the channel furthest from the barrier 94.

Embodiments of an acoustic lens in accordance with the present disclosure, described above, utilize brackets to hold the sheets in place. As an alternative to using brackets, in accordance with some embodiments, an acoustic lens can be made without brackets at all where the sheets are molded or formed from plastic or metal and the sheets have boss features (elements) that mate with the sheet above and below. The boss features can be formed with the sheets, or can be elements separate from the sheets and affixed to the sheets.

Figure 16:
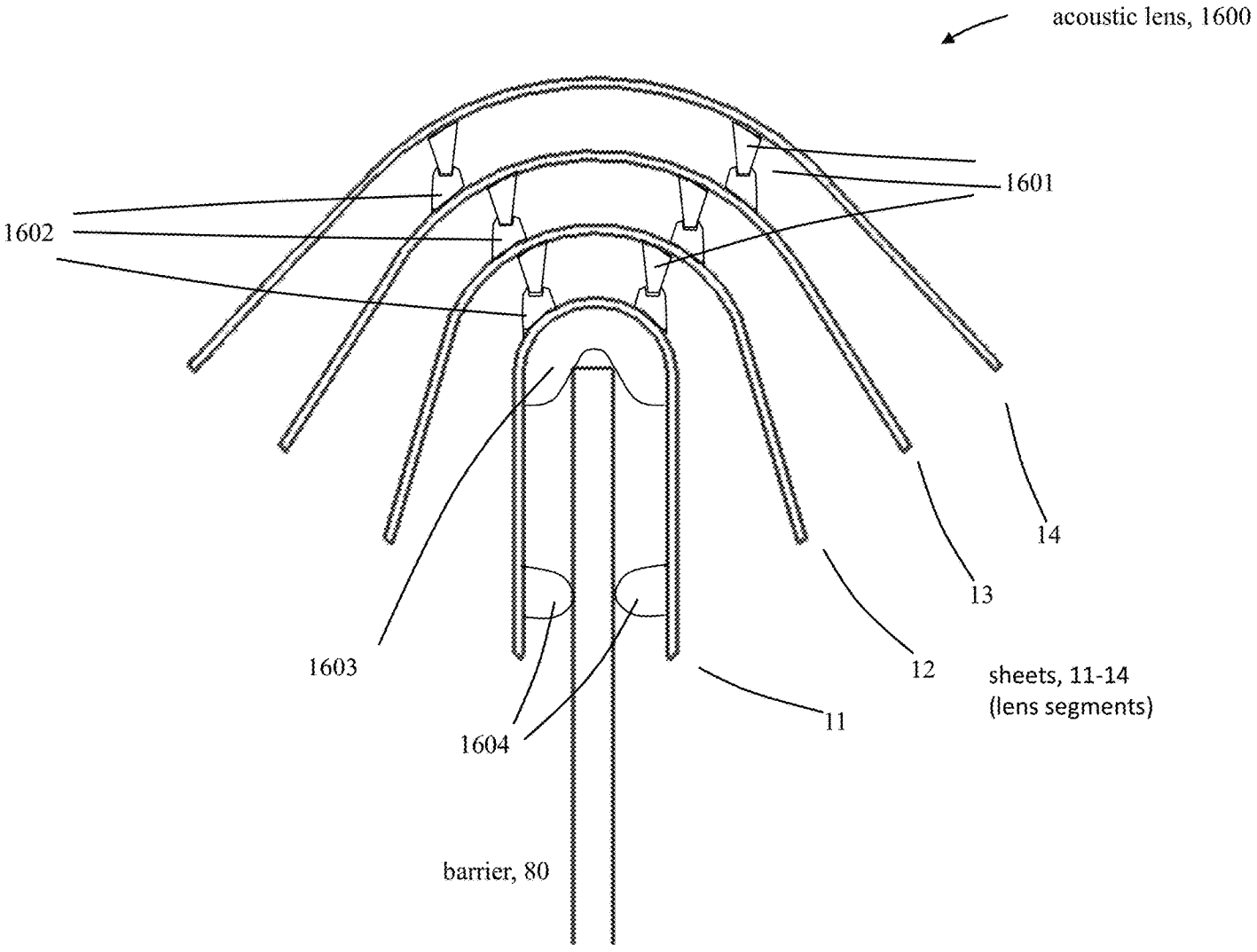
FIG. 16 shows another embodiment of the acoustic lens.

An acoustic lens 1600 in accordance with some embodiments is shown in FIG. 16. In this design, bottom bosses 1601 are located on the underside of sheets 12, 13, 14, and top bosses 1602 are located on upper side of sheets 11, 12, 13. The sheet 11 at the bottom of the stack of sheets would also have a rib 1603 to offset the bottom sheet from the barrier and a rib 1604 on each side of the barrier to hold the whole lens upright. The bottom bosses on one sheet connect to the top bosses on the sheet below. For example, bottom bosses 1601 on sheet 14 connect to corresponding top bosses 1602 on sheet 13. Likewise, bottom bosses 1601 on sheet 13 connect to corresponding top bosses 1602 on sheet 12. Bottom bosses 1601 on sheet 12 connect to corresponding top bosses 1602 on sheet 11, and so on.

The bottom and upper bosses on the sheets are spaced apart so that when the sheets are connected, a curve is imparted to the sheets as a result of the spacings of the bottom and top bosses. The spacing between bosses decrease from one sheet (e.g., 14) to an adjacent lower sheet (e.g., 13), in order to increase the amount of curvature in the sheets from the upper sheet to the lower sheet. The amount of curvature in the upper sheet (e.g., 14) can be controlled by the spacing between the bottom bosses 1601 of the upper sheet relative to the spacing between the top bosses 1602 of the adjacent lower sheet (e.g., 13).

The sheets would all stack by way of the bosses snapping together or by fastening the bosses together, for example, by screws that go through the bosses. An advantage of formed sheets is that they can be made out of more permanent and durable and cleanable materials.

The invention claimed is:

1. A bracket for an acoustic lens, the bracket comprising:

a frame;

a plurality of segments joined in spaced apart fashion to the frame, the plurality of segments having corresponding concave-shaped support surfaces for supporting corresponding constituent sheets of the acoustic lens, wherein the corresponding constituent sheets of the acoustic lens are supported by being pressed against the corresponding support surfaces to conform the sheets to the concave shapes of the support surfaces, wherein the sheets are spaced apart and define acoustic channels between the sheets; and a plurality of catches formed where the plurality of segments join the frame, each catch having a lip and a gap formed between the lip and a portion of the support surface of the segment where said each catch is formed, wherein the gaps of the plurality of catches receive edges of the constituent sheets of the acoustic lens to further support the sheets against the support surfaces, wherein the segments are aligned such that apexes of the corresponding support surfaces are aligned.

2. The bracket of claim 1, wherein the apex of an innermost support surface has highest curvature among the support surfaces and the apex of an outermost support surface has least curvature among the support surfaces.

3. The bracket of claim 1, wherein each concave support surface has varying curvature such that the apex of a sheet supported by said each support surface has higher curvature than a leading edge of the sheet.

4. The bracket of claim 1, wherein the frame includes a mounting slot for mounting the bracket to a barrier, wherein the apexes of the corresponding support surfaces are in alignment with a plane passing through the mounting slot.

5. The bracket of claim 1, wherein portions of the support surfaces on one side of their respective apexes extend the same distance from the apexes as portions of the support surfaces on the other side of their respective apexes.

6. The bracket of claim 1, wherein portions of the support surfaces on one side of their respective apexes extend further from the apexes than portions of the support surfaces on the other side of their respective apexes.

7. The bracket of claim 1, wherein the bracket is a single piece formed of injection-molded material.

8. A bracket for an acoustic lens, the bracket comprising:

a frame; and a plurality of concave guides joined in spaced apart fashion to the frame for supporting corresponding constituent sheets of the acoustic lens, wherein the corresponding constituent sheets of the acoustic lens are supported by being pressed against the concave guides to conform the sheets to the concave shapes of the guides, wherein the sheets are spaced apart and define acoustic channels between the sheets, wherein the concave guides are aligned such that apexes of the concave guides are in alignment, wherein each concave guide has varying curvature such that the apex of a sheet supported by said each concave guide has higher curvature than a leading edge of the sheet, wherein the apex of an innermost guide has highest curvature among the plurality of concave guides and the apex of an outermost guide has least curvature among the plurality of concave guides.

9. The bracket of claim 8, wherein each concave guide comprises a slot to receive and guide a constituent sheet of the acoustic lens, wherein a top portion of the slot constrains the sheet from the top and a bottom portion of the slot constrains the sheet from the bottom.

10. The bracket of claim 8, wherein each concave guide comprises a top arch to constrain the shape of a sheet and a catch to receive a leading edges of the sheet to press the sheet upward against the concave guide.

11. The bracket of claim 8, wherein portions of the concave guides on one side of their respective apexes extend the same distance from the apexes as portions of the concave guides on the other side of their respective apexes.

12. The bracket of claim 8, wherein portions of the concave guides on one side of their respective apexes extend further from the apexes than portions of the concave guides on the other side of their respective apexes.

13. The bracket of claim 8, wherein the bracket is a single piece formed of injection-molded material.

14. An acoustic lens comprising:

a plurality of sheets; and means for securing the sheets in spaced apart fashion to define acoustic channels between the sheets and for conforming the sheets to a concave shape along the lengths of the sheets, wherein apexes of the concave-conformed sheets are aligned, wherein the apex of an innermost concave-conformed sheet has highest curvature among the concave-conformed sheets and the apex of an outermost concave-conformed sheet has least curvature among the concave-conformed sheets, wherein each concave-conformed sheet has varying curvature such that the apex of said each concave-conformed sheet has higher curvature than a leading edge of said each concave-conformed sheet.

15. The acoustic lens of claim 14, wherein the means for securing the sheets includes a mounting slot to mount the acoustic lens on a barrier, wherein the apexes of the concave-conformed sheets are in alignment with a plane of the barrier.

16. The acoustic lens of claim 14, wherein portions of the concave-conformed sheets on one side of their respective apexes extend the same distance from the apexes as portions of the concave-conformed sheets on the other side of their respective apexes.

17. The acoustic lens of claim 14, wherein portions of the concave-conformed sheets on one side of their respective apexes extend further from the apexes than portions of the concave-conformed sheets on the other side of their respective apexes.

18. The acoustic lens of claim 14, wherein the means for securing the sheets comprises one or more brackets, each bracket having a plurality of curved slots to receive the plurality of sheets, wherein a top portion of each slot constrains the sheet at the apex and a bottom portion of each slot constrains the sheet from the bottom.

19. The acoustic lens of claim 14, wherein the means for securing the sheets comprises one or more brackets, each bracket having a plurality of curved segments having a support surface against which the plurality of sheets are pressed against to conform the sheets to the concave shape.

20. The acoustic lens of claim 19, wherein each curved segment includes opposing catches to secure leading edges of a corresponding sheet to urge the sheet against the support surface of said each curved segment.

21. The acoustic lens of claim 14, wherein the means for securing the sheets comprises a plurality of boss features on each sheet, the boss features on an upper sheet spaced further apart than boss features of an adjacent lower sheet, the boss features on the upper sheet configured to connect to boss features of the adjacent lower sheet to impart a curved profile on the upper sheet.

* * * * *